US005809375A

United States Patent [19]

Owens, Jr. et al.

[11] Patent Number: 5,809,375

[45] Date of Patent: Sep. 15, 1998

[54] MODULAR XEROGRAPHIC CUSTOMER REPLACEABLE UNIT (CRU)

[75] Inventors: Alvin J. Owens, Jr., Fairport; David E. Rollins, Lyons; Douglas W. Sass, Ontario; Robert S. Pozniakas, Rochester; Robert A. Gross, Penfield; Fredrick M. Hausner, Churchville; Daniel H. Burnett, Fairport; Michael E. Beard, Webster; Ahmed-Mohsen T. Shehata, Penfield; John A. Wargo, Farmington; James L. Giacobbi, Penfield; Richard M. Baran, Webster; David J. Lemmon, Hilton, all of N.Y.

[73] Assignee: Xerox Corporation, Stamford, Conn.

[21] Appl. No.: 827,847

[22] Filed: Apr. 11, 1997

[51] Int. Cl.[6] ..... G03G 21/16

[52] U.S. Cl. ..... 399/111

[58] Field of Search ..... 399/108, 110, 399/107, 111, 113, 115, 116, 117, 120, 119, 121, 123, 125, 93

[56] References Cited

U.S. PATENT DOCUMENTS

| | | | |
|---|---|---|---|
| 4,540,268 | 9/1985 | Toyono et al. | 399/93 |
| 4,693,588 | 9/1987 | Yarbrough et al. | 399/93 |
| 5,204,717 | 4/1993 | Reese et al. | 399/115 |
| 5,243,384 | 9/1993 | Everdyke et al. | 399/116 |

*Primary Examiner*—S. Lee

*Attorney, Agent, or Firm*—Kevin R. Kepner

[57] ABSTRACT

A xerographic CRU (Customer Relpaceable Unit) for an electrophotographic printing machine. The xerographic CRU has retaining features and cooperates with a drive module with certain retractable features that allow the insertion and removal of the CRU without causing damage to the photoreceptor and other critical subsystems. The unit further has many locating members for other subsystems so that critical tolerances are maintained. An interface with a single handle assembly retracts/unlocks and extends/locks the drive module and the associated CRU subsystems into an operative position. The CRU also has electrical and drive connections for the cleaning system, the charging system and transfer/detack.

10 Claims, 6 Drawing Sheets

MODULAR XEROGRAPHIC CUSTOMER REPLACEABLE UNIT (CRU)

This invention relates generally to a customer replaceable unit (CRU) for a printing machine, and more particularly concerns a photoreceptor module for an electrophotographic printing machine.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In printing machines such as those described above, a CRU is a customer replaceable unit which can be replaced by a customer at the end of life or at the premature failure of one or more of the xerographic components. The CRU concept integrates various subsystems whose useful lives are predetermined to be generally the same length. The service replacement interval of the CRU insures maximum reliability and greatly minimizes unscheduled maintenance service calls. Utilization of such a strategy, allows customers to participate in the maintenance and service of their copiers/printers. CRUs insure maximum up time of copiers and minimize downtime and service cost due to end of life or premature failures.

It is desirable to have a CRU that enables a variety of machine subsystems to be incorporated into a single unit while maximizing the useful life of each component. It is further desirable to utilize a CRU that allows service to a machine to be performed efficiently and at a relatively low cost and in some cases to be serviced by the user himself. It is a further benefit to have the ability to reuse and recycle various CRU components in today's climate of environmental awareness.

In accordance with one aspect of the present invention, there is provided A xerographic module for an electrophotographic printing machine, comprising a housing, a plurality of xerographic components mounted on said housing and an interlock mechanism mounted on said housing and interfacing with some of said plurality of xerographic components, wherein upon insertion of said housing into a printing machine and actuation of said interlock mechanism with a single actuator, all of said plurality of xerographic components are positioned in an operative position.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
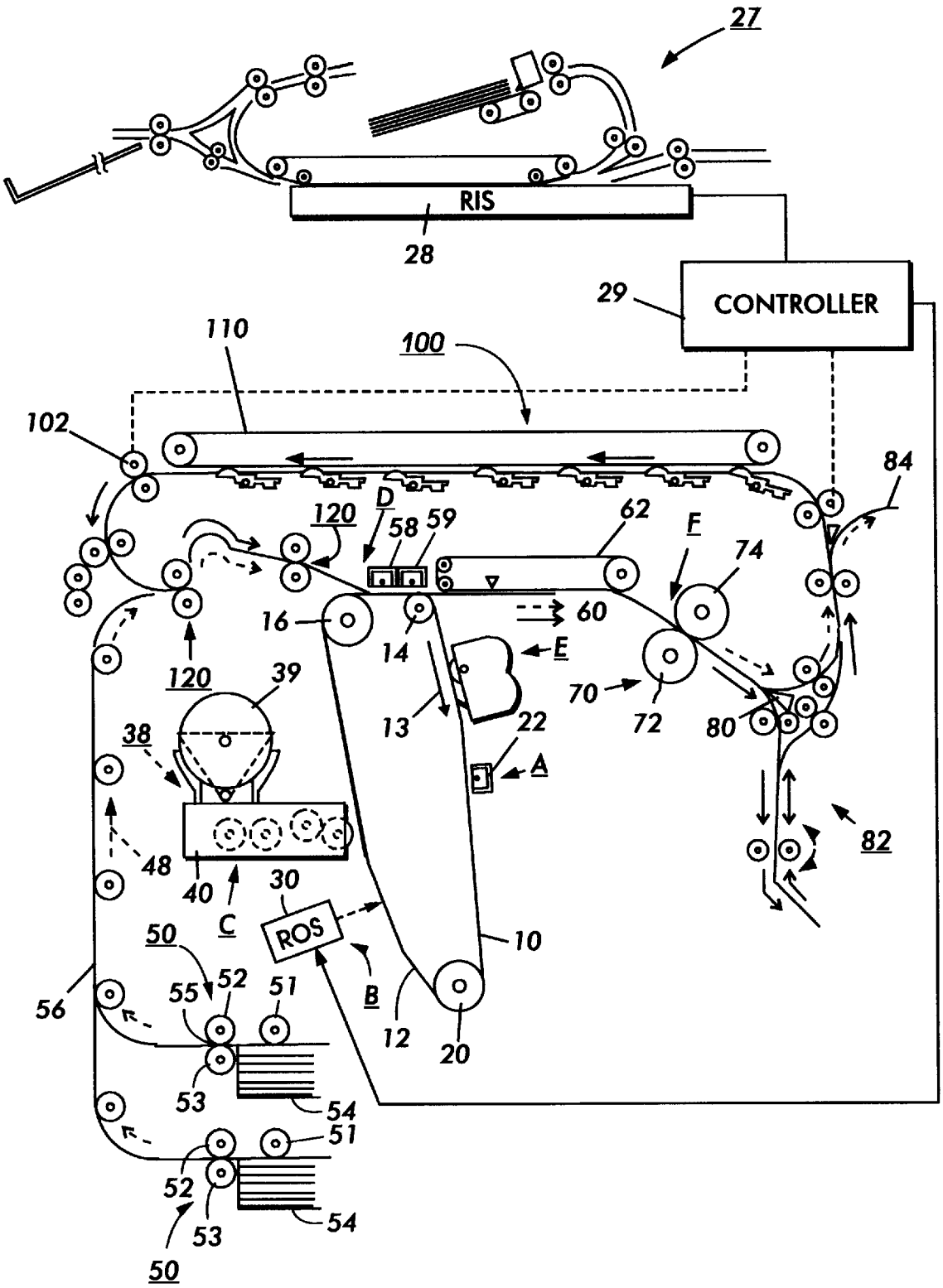
FIG. 1 is a schematic elevational view of a typical electrophotographic printing machine utilizing the modular xerographic customer replaceable unit of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the modular xerographic customer replaceable unit of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc.. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
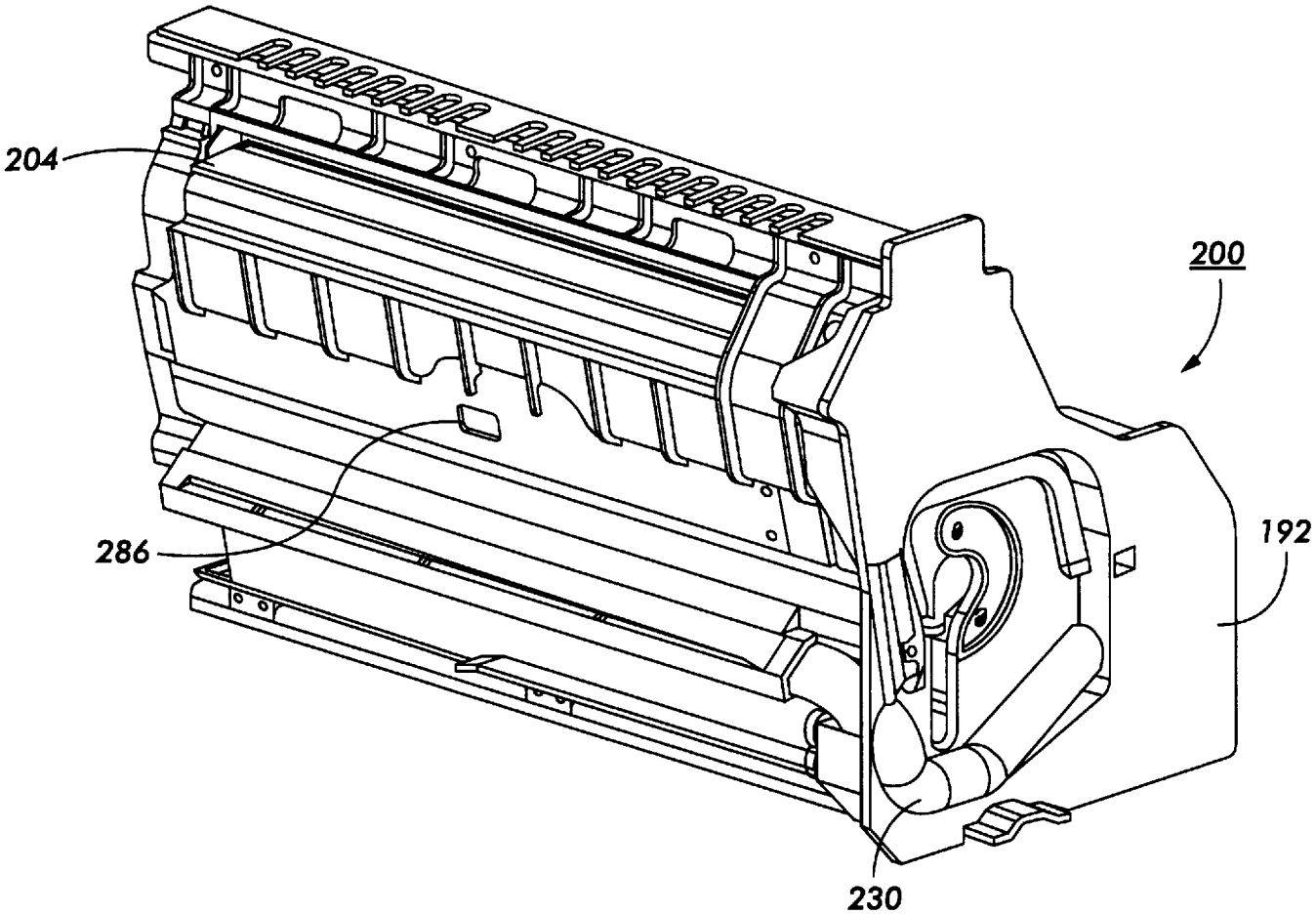
FIG. 2 is a perspective view of one side of a xerographic CRU.
Figure 3:
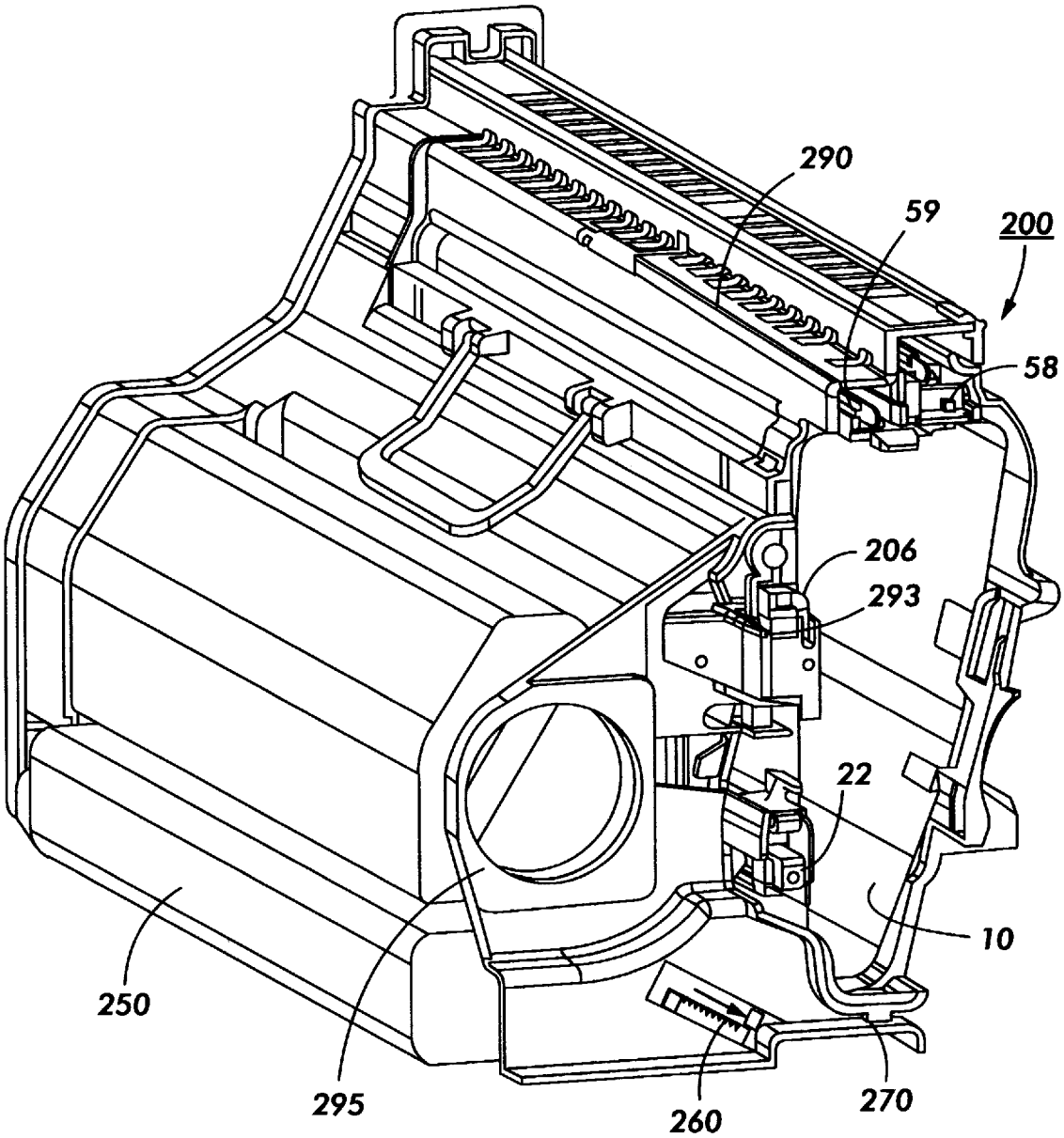
FIG. 3 is a perspective view of the opposite side of the FIG. 2 CRU.
Figure 4:
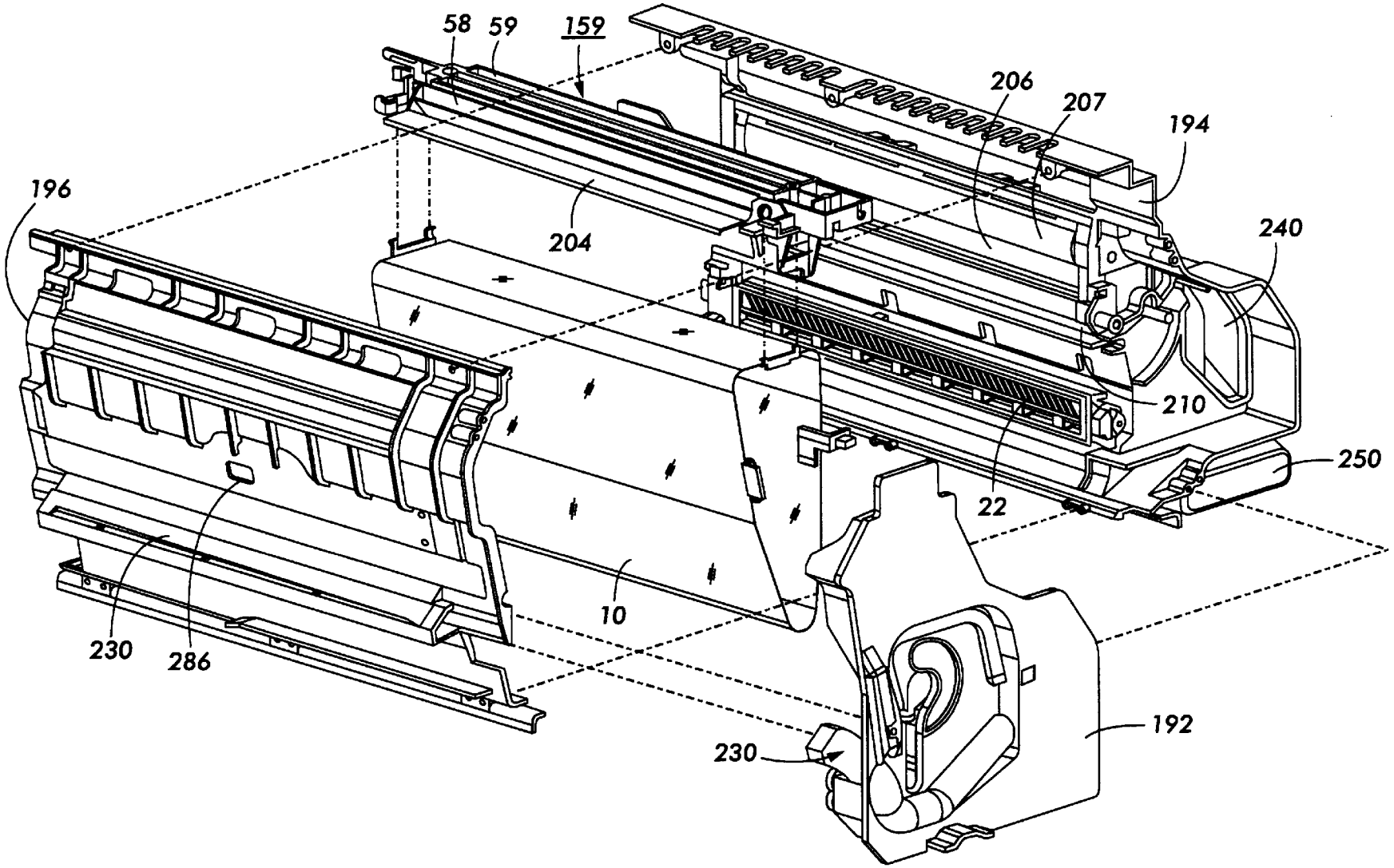
FIG. 4 is an exploded perspective view of the xerographic CRU module further illustrating the components thereof.

Turning next to FIGS. 2 and 3, there is illustrated perspective views of the xerographic customer replaceable unit (CRU) 200. The xerographic CRU 200 module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor(P/R) belt 10, the noise, ozone, heat and dirt (NOHAD) handling manifolds 230 and filter 240, the waste bottle 250, the drawer connector 260, CRUM 270, the automatic cleaner blade engagement/retraction and automatic waste door open/close device (not illustrated).

A summary of the xerographic CRU components and the function of each is as follows:

Cleaner (Doctor blade 206 and Disturber Brush 207): remove untransferred toner from the photoreceptor; transport waste toner and other debris to a waste bottle 250 for storage; assist in controlling the buildup of paper talc, filming and comets on the photoreceptor belt.

Precharge Erase Lamp 210: provides front irradiation of the photoreceptor to the erase the electrostatic field on the surface Charge Pin Scorotron 22: provides a uniform charge level to the photoreceptor belt in preparation for imaging.

Photoreceptor Belt 10: charge retentive surface advances the latent image portions of the belt sequentially through various xerographic processing stations which converts electrostatic field on the surface Pretransfer Paper Baffles 204: directs and controls tangency point between the paper and photoreceptor surface. Creates an "S" bend in paper to flatten sheet in the transfer zone.

Transfer Wire Corotron 58: places a charge on the paper as in passes under the corotron. The high positive charge on the paper causes the negative charged toner to transfer from the photoreceptor to the paper.

Detack Pin Corotron 59: assist in removing paper with its image from the photoreceptor by neutralizing electrostatic fields which may hold a sheet of paper to photoreceptor 10. Sheet self strips as it passes over a stripper roll 14 on belt module 300.

NOHAD Dirt Manifolds 230 and Filter 240: removes airborne toner dirt and contaminates from the moving air before it leaves the CRU. The captured toner and contaminates are deposited in a dirt filter contained in the xerographic CRU.

Electrical Drawer Connector 260: provides connector interface for the CRUM; provides input/output for machine control.

CRUM (Customer Replacement Unit Monitor) Chip 270: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and Developer Interface: provides a developer interface window to allow transfer of toner for imaging from developer donor roll 47 to P/R belt surface 12 latent image; Also, provides critical parameter mounting and location link which ties ROS 30 to P/R module 300 to ensure proper imaging and eliminate motion quality issues.

BTAC Sensor Interface 286: provides interface window to monitor process controls.

Registration Transport Interface 288: provides outboard critical parameter location and mounting feature.

Prefuser Transport Interface 290: provides critical parameter location and mounting feature.

The CRU subsystems are contained within the xerographic housing 190. The housing consist of three main components which include the front end cap 192, right side housing 194 and left side housing 196. The xerographic housing 190 is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system with out damage or difficulty The front end cap 192 joins the right 194 and left side 194 housings together on the outboard end of the CRU 200. The front end cap 192 also functions as a mechanical link with features which mount and locate on the outboard of the machine the P/R module 200, ROS and registration transport in relationship to one another in order to achieve critical mechanical parameters. The end cap 192 also mounts spring loaded slide, waste door pivot and blade pivot links (not shown) which allows the customer to simultaneously engage and disengage the cleaner waste door and blade during install and removal of the CRU when the P/R module 300 handle 315 is rotated as described below. When removed from the machine, the blade pivot link insures the cleaner blade remains retracted to prevent P/R belt 10 and blade damage during CRU install and removal. The waste door pivot link secures the cleaner waste bottle door closed when the CRU 200 is removal to prevent spillage of toner during shipping. The end cap 192 also mounts a dirt manifold 230 which links the left side housing developer manifold with the NOHAD dirt filter 240 in the right side housing 194. The manifolds 230 transport airborne toner and other contaminates to the dirt filter 240 by means of an airflow stream.

The right side housing 192 also mounts and locates a number of the xerographic subsystems and interfaces internal and external to the CRU 200. The right side housing mounts one half of the transfer and detack assembly 400, charge scororton 22, P/R belt 10 and drawer connector 260. These components are allowed to float within the CRU housing. They achieve critical parameter locations with the P/R module 300 and machine frame when the CRU housing 200 is fully installed and the P/R module handle 315 engages the tension roll 20. Both the charge scorotron 22 and transfer/detack subsystem 159 are located by means of spring loads described in more detail below, located on the P/R module 300.

The right side 194 housing also contains molded scorotron retention features and mounts and locates a charge spring which retracts the charge scorotron subsystem to the housing when the CRU is removed from the machine. The spring enables successful install and removal of the CRU without damage to the charge scorotron. The right side housing has molded ports in the charge scorotron mounting area to allow non-contaminated air to flow over the charge device in order to remove any contaminates which would affect the performance of the unit. i.e. (nitrous oxide a cause of parking deletions).

The right side housing features molded vents at the transfer/detack location. The vents also allow sufficient air over the transfer and detack devices to prevent any nitrous oxide contamination.

The housing has special molded features which mount and locate the cleaner assembly 206, 207, precharge erase lamp 210, waste bottle 250 and NOHAD air duct 230 and filter 240. The right housing mounts and locates the interfaces of the cleaner blade and waste door pivot features. The housing positions the NOHAD air duct and filter 240 to the blower to allow sufficient airflow to capture airborne contaminates and toner.

Due to the "point of load" power supplies and distributed drives used in some machines, the blower had to be mounted in front of the back wall of the machine. The system collects air borne contaminants in manifolds 230 and ducts while pulling the air forward through the CRU 200, air is then pulled rearward through a filter 240 housed in a tube shaped duct housed in the CRU. This ducting configuration provides space for a high carrying capacity filter with a large surface area, which removes dirt efficiently for the life of the CRU. One big advantage is that with each new CRU, fresh filter medium is presented, dirt is removed with the CRU thus minimizing dirt accumulation elsewhere in the machine. The blower interface duct 295 is seen in FIG. 3.

The exiting air from the blower would typically be ducted through a ozone filter and exhausted directly outside the machine. In this system, exhausting the air inside the cavity and later collecting it with a fan, allows for better ozone decay (as noted above). In addition, this method allows for a much more efficient ozone filtering due to slower air speed going through the ozone filter element, and achieves ozone filtration with only one ozone filter (not all the ozone stays inside the CRU). Not having a ozone filter on the blower exit also enables the creation of more pressure for a given blower size, cost, power draw, and acoustic noise, thus cleaning the CRU more efficiently.

The filter is made of a inexpensive polyester, and secured with a plastic collar, which creates a seal by crushing the filter medium when in place in the CRU. This filter medium will be removed and the collar reused when the CRU is reconditioned. The blower is controlled by software to turn on whenever the machine is running and to stay on for some time period after the machine is shut down to continue purging emissions.

The P/R belt 10 is partially retained by molded fingers 402 with are located on the inboard and outboard areas of the right housing. Other retaining belt fingers 400 are located on the transfer detack housing and left side housing. The housing has a molded feature at the lower outboard end which positions the belt on the P/R module to prevent belt damage.

The left side housing 196 serves as protective cover for the P/R belt 10 and provide interface windows with various subsystems surrounding the CRU. The interface windows include the BTAC 286, developer and ROS. The housing also mounts one half of the transfer detack subsystem. It also provides an interface window with the registration transport for the entry of paper. The developer dirt manifold 230 is also mounted and located on the left side housing 196. Two of the belt retaining fingers and a molded feature at the lower outboard end retain and position the P/R belt 10 during install and removal. The left side housing has a molded baffle which covers ROS on outboard end to prevent customer exposure to the ROS beam.

The integrated CRU housing has features which ramp the registration transport and prefuser transport into position when the unit is installed in the machine. The CRU housing makes 22 critical mechanical and electrical interfaces almost simultaneously. All the housings possess double bosses which allows the unit to be secured together during the manufacturing build. If both bosses happen to strip out over time, a longer screw can be used to secure the parts due to sufficiently deep bosses.

Figure 5:
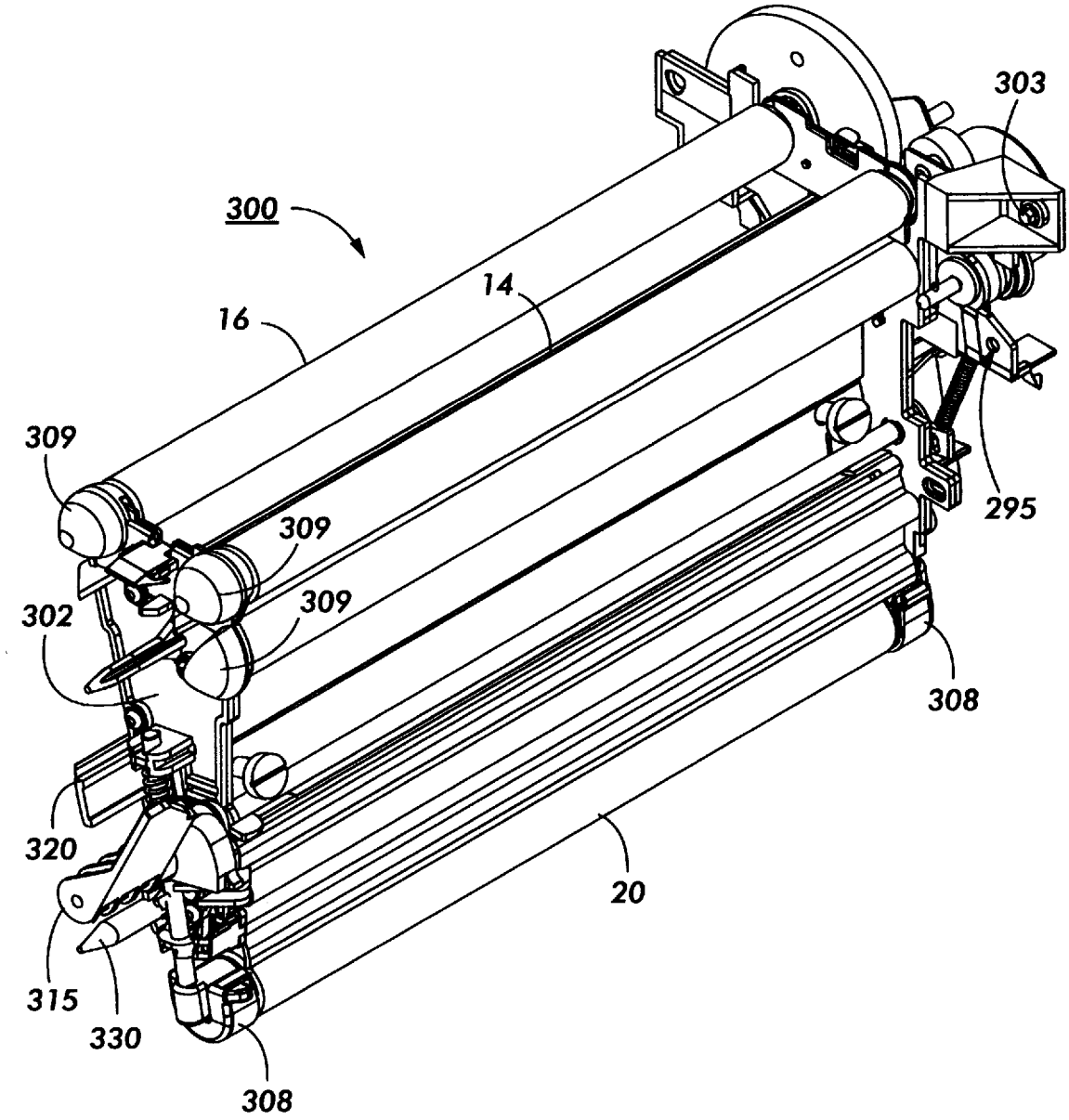
FIG. 5 is a perspective view of the photoreceptor belt drive module.
Figure 6:
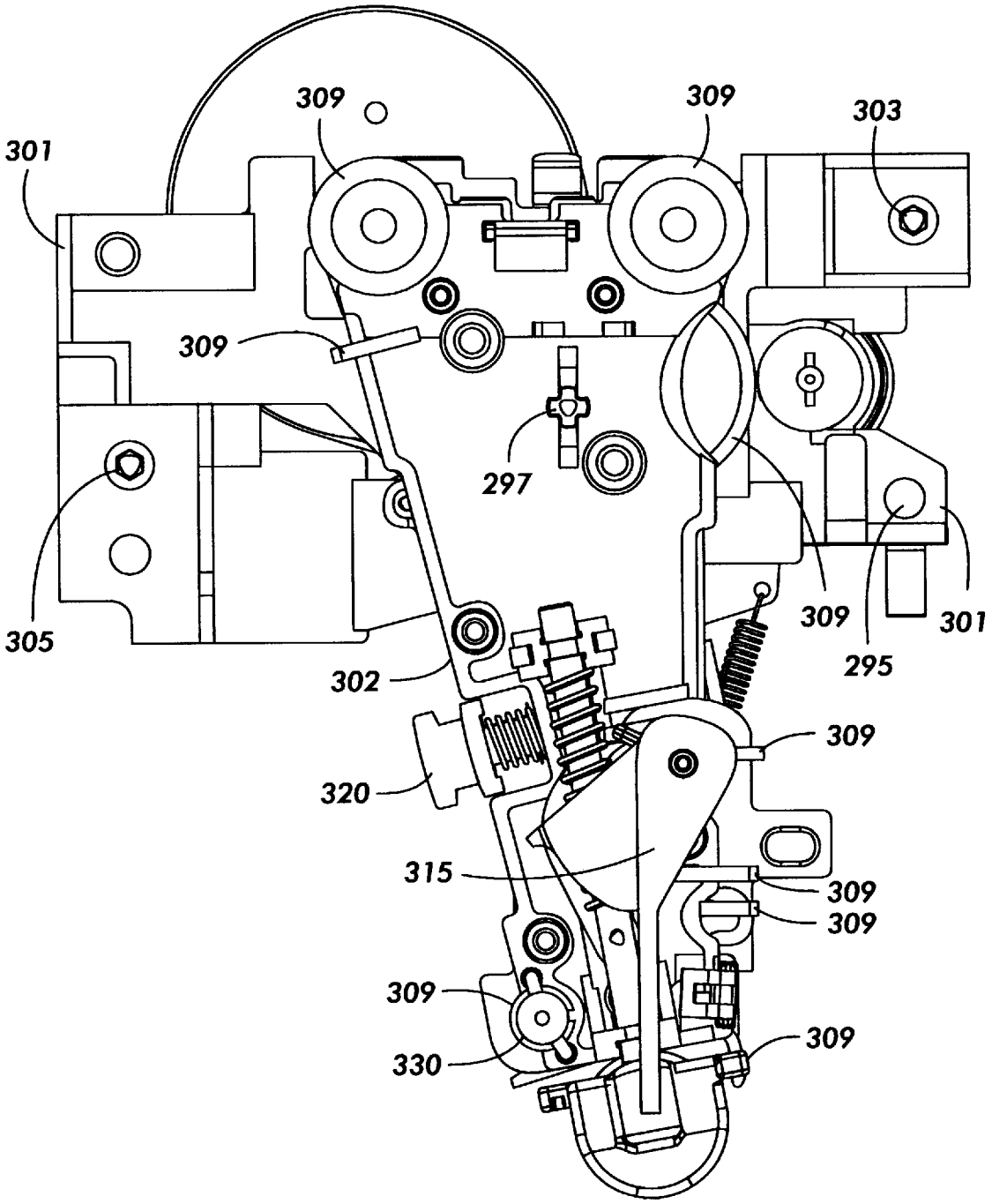
FIG. 6 is an end view of the FIG. 5 drive module.

Turning next to FIGS. 5 and 6 the P/R module 300 is shown, the module, generally referred to as reference numeral 300, must interface with several sub systems: xerographic charging, imaging, development, paper registration, transfer, cleaning, erase, the machine frames, and the xerographic CRU. The unit's primary function is to rotate the photoreceptor (P/R) belt 10 to the various xerographic sub systems in order to transfer a toner image from the belt to a sheet of paper.

The photoreceptor (P/R) module 300 is mounted to the machine frames on the machine frames backplate with two fasteners using mounting holes 303, 305. The imager backer bar 330 locates in a hole in the machine frames backplate. A second feature, to eliminate rotation, is on the P/R module rear plate 301. When mounted, the P/R module 300 is cantilevered off the machine frames backplate until the xerographic CRU 200 is inserted into position.

By rotating the P/R module handle 315 clockwise to a substantially vertical position, the tension roll 20 and developer backer bar 320 are contracted, allowing the user to insert/remove the xerographic CRU 200 without interference or damage to components. After the xerographic CRU 200 is fully inserted, the user rotates the handle 315 counter clockwise approximately 150° to return the tension roll 20 and developer backer bar 320 to their operating positions.

The xerographic CRU 200 locates to the P/R module 300 in the rear with a hole/pin 295, 293 interface between the xerographic CRU 200 and the rear plate 301 of the P/R module 300. The front interface is also accomplished this way, however the pin 297 on the front plate 302 of the P/R module 300 and the image backer bar 330 on the P/R module 300 are supported by the xerographic CRU 200. The front plate of the P/R module 302, along with the P/R module handle 315 and the P/R module edge guides 308 have features 309 to guide the P/R belt 10 over the front of the P/R module 300 assembly eliminate P/R belt damage due to insertion to the xerographic CRU 200.

While the invention herein has been described in the context of black and white photoreceptor CRU, it will be readily apparent that the device can be utilized in any electrophotographic printing machine in which ease of service and customer service ability is desired.

In recapitulation, there is provided a xerographic CRU for an electrophotographic printing machine. The xerographic CRU has retaining features and cooperates with a drive module with certain retractable features that allow the insertion and removal of the CRU without causing damage to the photoreceptor and other critical subsystems. The unit further has many locating members for other subsystems so that critical tolerances are maintained. An interface with a single handle assembly retracts/unlocks and extends/locks the drive module and the associated CRU subsystems into an operative position. The CRU also has electrical and drive connections for the cleaning system, the charging system and transfer/detack.

It is, therefore, apparent that there has been provided in accordance with the present invention, a xerographic CRU module that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A xerographic module for an electrophotographic printing machine, comprising:

a housing;

a plurality of xerographic components mounted on said housing;

an interlock mechanism mounted on said housing and removably engageable with a photoreceptor module and interfacing with some of said plurality of xerographic components, wherein upon insertion of said housing into a printing machine and actuation of said interlock mechanism with a single actuator, all of said plurality of xerographic components are positioned in an operative position.

2. A xerographic module according to claim 1, further comprising:

an air manifold formed into said housing;

a filter device located in said housing and connected to a portion of said air manifold so that contaminated air is drawn from said housing and through said filter.

3. A xerographic module according to claim 1, further comprising a plurality of electrical connectors connected to a portion of said plurality of xerographic components so that upon insertion of said housing into the printing machine and actuation of said interlock mechanism, said plurality of xerographic components are energized.

4. A xerographic module according to claim 1, further comprising a waste toner container integral to said housing so that toner removed from a photoreceptive member is captured.

5. A xerographic module according to claim 1, wherein one of said plurality of xerographic components comprises a photoreceptive member retained in said housing, wherein said photoreceptive member is inserted into the printing machine in unison with said housing and position adjacent a photoreceptor support and drive member so that said photoreceptor is positioned in an operative position upon actuation of said interlock mechanism.

6. A xerographic module according to claim 1, wherein one of said plurality of xerographic components comprises a transfer detack assembly, said transfer detack assembly being loosely constrained by said housing and wherein upon insertion of said housing into the printing machine and actuation of said interlock mechanism, said transfer detack assembly is positioned with respect to a photoreceptive member in said housing.

7. A xerographic module according to claim 1, wherein one of said plurality xerographic components comprises a cleaner assembly, including a disturber brush and a doctor blade, wherein said cleaner assembly is positioned in a retracted position away from a photoreceptive member in said housing and wherein upon insertion of said housing into the printing machine and actuation of said interlock mechanism, said cleaner assembly is extended into contact with the photoreceptive member.

8. A xerographic module according to claim 1, further comprising a Customer Replaceable Unit Monitor (CRUM), wherein said CRUM emits certain control signals to a machine controller indicative of a status of various xerographic components housed on said housing.

9. A xerographic module according to claim 1, wherein one of said xerographic components comprises a charge corona generating device said charge corona generating device being loosely constrained by said housing and wherein upon insertion of said housing into the printing machine and actuation of said interlock mechanism, said charge corona generating device is positioned with respect to a photoreceptive member in said housing.

10. A xerographic module for an electrophotographic printing machine, comprising:

a housing:

a plurality of xerographic components mounted on said housing;

an interlock mechanism mounted on said housing and interfacing with some of said plurality of xerographic components, wherein upon insertion of said housing into a printing machine and actuation of said interlock mechanism with a single actuator, all of said plurality of xerographic components are positioned in an operative position, wherein one of said xerographic components comprises a cleaner assembly, including a disturber brush and a doctor blade, wherein said cleaner assembly is positioned in a retracted position away from a photoreceptive member in said housing and wherein upon insertion of said housing into the printing machine and actuation of said interlock mechanism, said cleaner assembly is extended into contact with the photoreceptive member and further comprising a waste toner receptacle connected to said cleaner assembly and a gate member placed between said cleaner assembly and said waste toner receptacle wherein said gate member is in a normally closed position and wherein upon insertion of said housing into the printing machine and actuation of said interlock mechanism, said gate member opens to allow toner to flow from said cleaner assembly to said waste toner receptacle.

* * * * *